US010797435B2

(12) United States Patent
Linderman

(10) Patent No.: US 10,797,435 B2
(45) Date of Patent: Oct. 6, 2020

(54) METHOD AND APPARATUS FOR SECURING A SEGMENTED POWER CABLE FOR SHIPPING AND STORAGE

(71) Applicant: Enphase Energy, Inc., Petaluma, CA (US)

(72) Inventor: Ryan Linderman, Oakland, CA (US)

(73) Assignee: Enphase Energy, Inc., Petaluma, CA (US)

( * ) Notice: Subject to any disclaimer, the term of this patent is extended or adjusted under 35 U.S.C. 154(b) by 793 days.

(21) Appl. No.: 14/918,094

(22) Filed: Oct. 20, 2015

(65) Prior Publication Data

US 2016/0111817 A1 Apr. 21, 2016

Related U.S. Application Data

(60) Provisional application No. 62/095,430, filed on Dec. 22, 2014, provisional application No. 62/066,278, filed on Oct. 20, 2014.

(51) Int. Cl.

| | |
|---|---|
| ***H01R 13/60*** | (2006.01) |
| ***H01R 13/443*** | (2006.01) |
| *H01R 13/627* | (2006.01) |

(52) U.S. Cl.

CPC ..... *H01R 13/60* (2013.01); *H01R 13/443* (2013.01); *H01R 13/6271* (2013.01)

(58) Field of Classification Search

CPC .. H01R 13/60; H01R 13/443; H01R 13/6271; H01R 13/506; B65D 63/10; B65B 35/50; B65B 35/52; H01B 13/01254; B65H 2701/34

USPC ..... 53/447

See application file for complete search history.

(56) References Cited

U.S. PATENT DOCUMENTS 2,556,188 A * 6/1951 Jakob ..... B65B 35/50 53/149
4,971,200 A * 11/1990 Huang ..... B65D 21/0235 206/420
5,081,821 A * 1/1992 Meives ..... B65B 25/14 271/202
5,123,534 A * 6/1992 Chwang ..... B65D 85/42 206/419
5,168,999 A * 12/1992 Lee ..... B65D 25/105 206/420

(Continued)

FOREIGN PATENT DOCUMENTS

| | | | |
|---|---|---|---|
| JP | 07029662 | A | 1/1995 |
| JP | 2010277904 | A | 12/2010 |
| KR | 200349431 | Y1 | 5/2004 |

OTHER PUBLICATIONS

International Search Report and Written Opinion dated Jan. 28, 2016 for PCT Application No. PCT/US2015/056418.

*Primary Examiner* — Dariush Seif
(74) *Attorney, Agent, or Firm* — Moser Taboada

(57) ABSTRACT

Exemplary embodiments of the present invention are drawn to a method and apparatus for securing a segmented cable in manufacturing and for shipping and storage. In some embodiments, the apparatus comprises two or more fixtures, each comprising a plurality of locking receptacles along a body of each fixture, wherein each of the plurality of locking receptacles comprises a locking mechanism to secure a connector of a plurality of connectors on a power cable.

14 Claims, 6 Drawing Sheets

(56) References Cited

U.S. PATENT DOCUMENTS 5,214,903 A * 6/1993 Chen ..... B65D 85/42 53/429
5,317,491 A * 5/1994 Lee ..... A47F 7/005 206/420
5,404,634 A * 4/1995 Takeshita ..... H01R 43/055 29/33 M
5,513,081 A * 4/1996 Byers ..... F21S 2/005 206/419
5,597,070 A * 1/1997 Wu ..... B65D 5/504 206/419
5,893,628 A * 4/1999 Byers ..... F21V 3/02 362/145
5,907,945 A * 6/1999 Doyle ..... B65D 85/42 206/419
7,316,591 B2 * 1/2008 Ferderer ..... H01R 13/506 439/532
8,955,680 B1 * 2/2015 Wu Lee ..... B65H 75/28 206/419
2001/0023775 A1 * 9/2001 Takada ..... H01R 43/28 174/72 A
2002/0193001 A1 * 12/2002 Yoshikawa ..... H01R 13/60 439/540.1
2004/0092154 A1 * 5/2004 Doorhy ..... H01R 4/2433 439/404
2009/0176412 A1 * 7/2009 Pavlovic ..... H01R 13/514 439/638
2009/0202212 A1 * 8/2009 Cox ..... G02B 6/4471 385/135
2010/0136842 A1 * 6/2010 Sakamoto ..... H01R 13/521 439/639
2010/0258157 A1 * 10/2010 Arai ..... H01R 13/52 136/244
2015/0087175 A1 * 3/2015 Stowers ..... H01R 13/514 439/284
2017/0207561 A1 * 7/2017 Scherer ..... H01R 12/721

* cited by examiner

METHOD AND APPARATUS FOR SECURING A SEGMENTED POWER CABLE FOR SHIPPING AND STORAGE

CROSS-REFERENCE TO RELATED APPLICATION

This application claims priority to U.S. Provisional Patent Application No. 62/066,278 filed on Oct. 20, 2014 and U.S. Provisional Patent Application No. 62/095,430 filed on Dec. 22, 2014, both of which are herein incorporated by reference in their entirety.

BACKGROUND OF THE INVENTION

1. Field of the Invention

Embodiments of the present disclosure relate generally to cable fixtures, and, in particular, to a method and apparatus for securing a segmented power cable for shipping and installation.

2. Description of the Related Art

Arrays of photovoltaic modules with microinverters at each module generally employ the use of a cable system with periodic splice connections that allow the modules to be connected in parallel to the AC bus. Traditionally this has been accomplished by having a long spool of cable with periodic splice box connectors that interface with a connector mounted to a short drop cable (e.g., a pigtail) mounted to each microinverter. An alternative is to have a receptacle or socket on the microinverter and to run short cable segments connecting each inverter to the next microinverter in parallel with each connector containing a Y-splice.

The approach with a drop cable connector and molded splice box defines a system with two AC connectors at each microinverter implying a large cost overhead. Another challenge for the large spooled up cable is related to the difficulty of removing a specific length of cable from the spool on the job site without creating an entanglement of the cables that must be straightened out during installation. This is especially true in an environment where it is not practical to wind up the cable as it is being removed from the larger spool such as on a rooftop with limited equipment space and resources.

Therefore, there is a need in the art for a method and apparatus for securing a segmented power cable for shipping and installation.

SUMMARY OF THE INVENTION

Embodiments of the present invention generally relate to securing a segmented cable for shipping and storage, substantially as shown in and/or described in connection with at least one of the figures, as set forth more completely in the claims.

These and other features and advantages of the present disclosure may be appreciated from a review of the following detailed description of the present disclosure, along with the accompanying figures in which like reference numerals refer to like parts throughout.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

According to some embodiments of the present invention, a segmented cable and cable management system is described to constrain and protect a series of symmetrically opposed electrical connectors mounted to fixed cable lengths from factory to field installation. According to one embodiment, the cable system only requires one AC connector per inverter promoting cost reduction and is more compact in shipping form factor compared to conventional round bobbin spooled cabling. The invention also simplifies the partitioning of segments at regional warehouses or on the job site.

Figure 1:
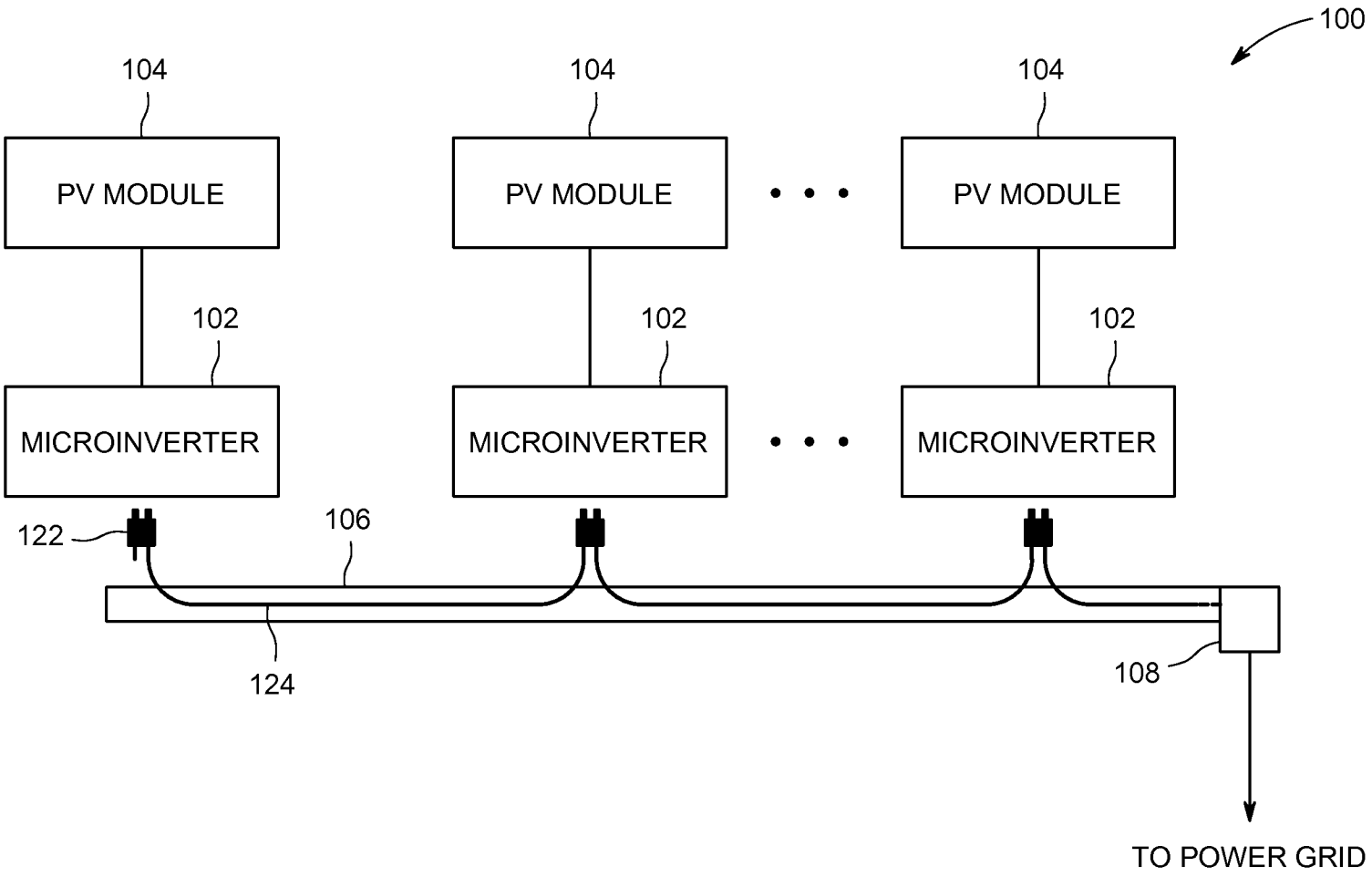
FIG. 1 is a diagram of a single connector cable system within a power conversion system in accordance with exemplary embodiments of the present invention.

FIG. 1 is a diagram of a single connector cable system within a power conversion system 100 in accordance with exemplary embodiments of the present invention. This diagram only portrays one variation of the myriad of possible system configurations. The present invention can function in a variety of distributed power generation environments and systems. The system 100 comprises a plurality of microinverters $\mathbf{102}_1$, $\mathbf{102}_2$ . . . $\mathbf{102}_n$, collectively referred to as microinverters 102, a plurality of PV modules $\mathbf{104}_1$, $\mathbf{104}_2$ . . . $\mathbf{104}_n$, collectively referred to as PV modules 104, an AC bus 106, and a detachment point 110. An alternative embodiment would replace some or all of the PV modules with battery storage units. Each microinverter $\mathbf{102}_1$, $\mathbf{102}_2$ . . . $\mathbf{102}_n$ is coupled to a PV module $\mathbf{104}_1$, $\mathbf{104}_2$ . . . $\mathbf{104}_n$, respectively. In some embodiments, a DC-DC converter may be coupled between each PV module 104 and each microinverter 102 (e.g., one converter per PV module 104).

The microinverters 102 are coupled to the AC bus 106, which in turn is coupled to the load center 108. The AC bus 106 is comprised of segmented cable 124 with a plurality of attached connectors 122. These connectors 122 may interlock directly with single connectors on the microinverters 102 to facilitate transmission of AC power, or, in some embodiments, interlock with drop cables connected to microinverters 102 or extension cables to other PV arrays.

The load center 108 houses connections between incoming power lines from a commercial power grid distribution system and the AC bus 106. The microinverters 102 convert DC power generated by the PV modules 104 into AC power, and meter out AC current that is in-phase with the AC commercial power grid voltage. The system 100 couples the generated AC power to the commercial power grid via the load center 108.

Figure 2:
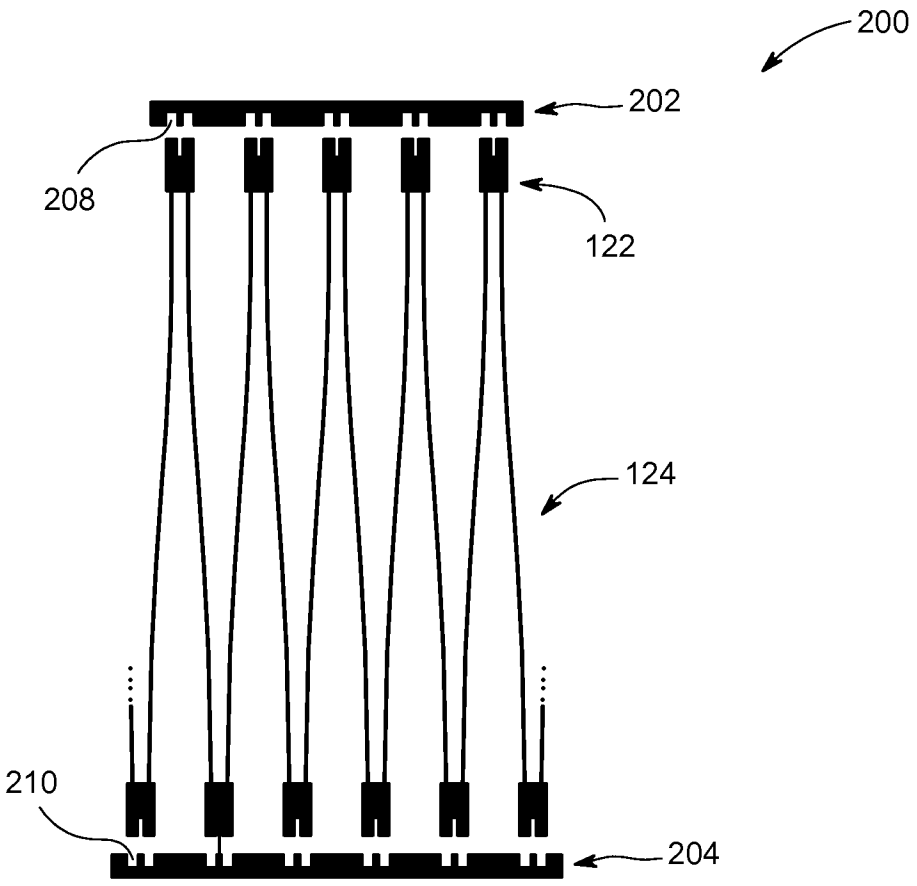
FIG. 2 is an illustration of a top-view of a cable system for storing the power cable in FIG. 1 in accordance with exemplary embodiments of the present invention.

FIG. 2 is an illustration of a top-view of a cable system 200 for storing the power cable 124 in FIG. 1 in accordance with exemplary embodiments of the present invention. The cable system can also be used to organize work in progress in the manufacturing facility.

The cable system 200 comprises a first fixture 202, a second fixture 204, the cable 124 and the connectors 122 attached to the cable 124. The first fixture 202 and the second fixture 204 secure the segmented cable 124 with connectors 122 during manufacturing, shipping and storage periods, eliminating entanglement generally associated with other cable systems such as spooled cables. The connector 122 contains an embedded T-splice in some embodiments. The first fixture 202 and the second fixture 204 each comprise a plurality of locking receptacles 208 which secure each connector 110 attached to the cable 124 in place. The locking receptacle 208 is designed in a manner so that a connector can be simply snapped into place so that the connector is free from rotational and translational movement. The connector may be any structure of connector generally supported by power systems and the locking receptacle 208 is designed accordingly.

The cable 124 is stacked together end-on-end with ease for shipping or storage as shown in FIG. 2 where each consecutive connector along the cable is secured to an opposing fixture. For example, the cable 124 is secured to the fixture by securing a first connector using one of the receptacles 208 along fixture 202, while the next connector along the body of the cable is secured to one of the receptacles along fixture 204, etc. Accordingly, the first fixture 202 secures a first set of connectors, and the second fixture 204 secures a second set of connectors on opposing sides as shown in FIG. 2.

According to some embodiments, each fixture supports 8 to 16 connectors, though the length of the fixture and number of locking receptacles can be adjusted according to specification. According to the example of 10 connectors, one layer of fixtures (e.g., 2 fixtures) supports up to 20 connectors. Each layer can then be stacked on top of another layer of fixtures, forming an array of fixtures for transport or storage, as shown in FIG. 3.

Those of ordinary skill in the art will recognize that the gap between each length of cable 124 between connectors 122 is merely for illustrative purposes; the cables are generally stored with little to no gap between each connector 122 leaving little to no gap between the cable length across the fixture, thus significantly reducing the amount of space used during shipping and storage. Additionally, though an embodiment for a 2-pole cabling system is shown here, the invention applies to a cabling system with any number of poles. The fixtures 202 and 204 may be composed of simple plastic or the like.

Figure 3:
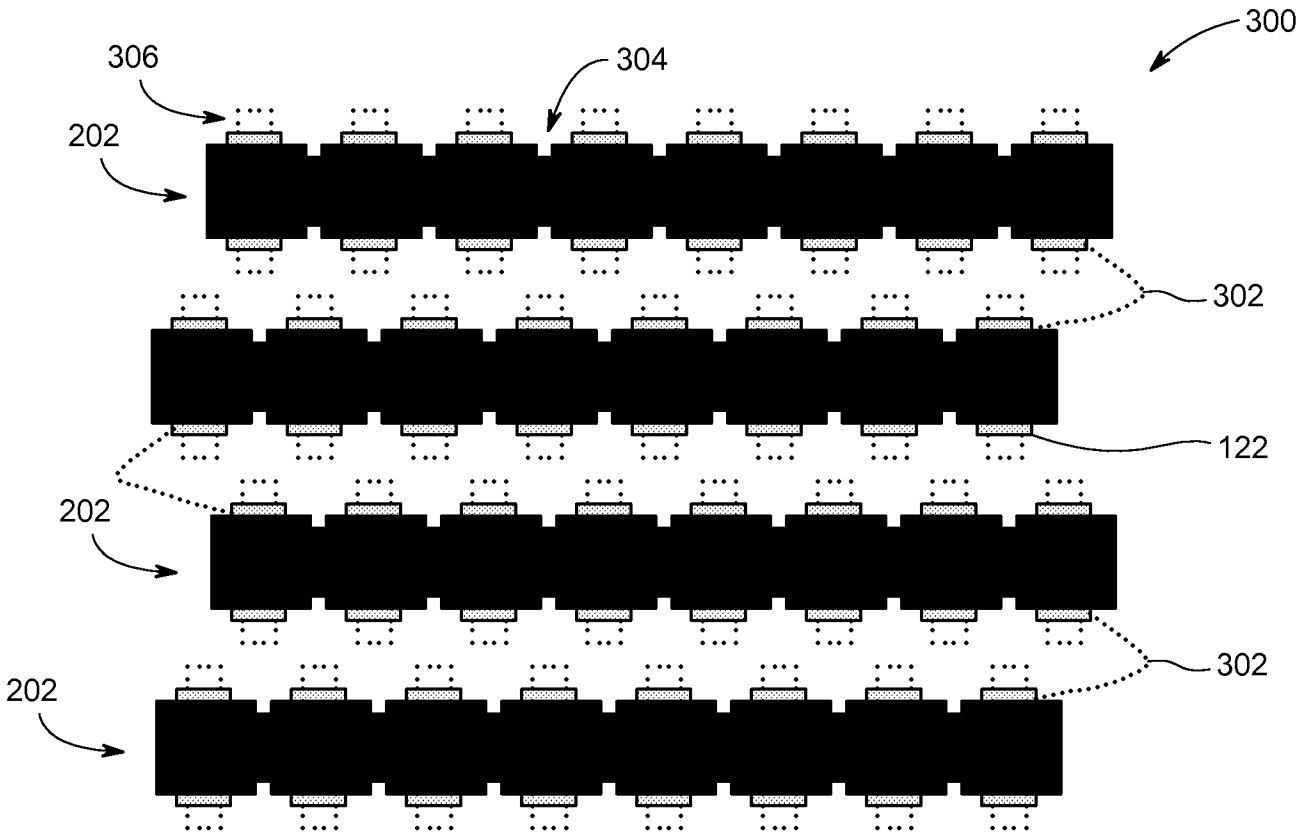
FIG. 3 is an illustration of a side-view of one array of fixtures in accordance with exemplary embodiments of the present invention.

FIG. 3 is an illustration of a side-view of one array of fixtures 300 in accordance with exemplary embodiments of the present invention.

In some instances, a long chain of cable 124 with many segments is manufactured. The fixtures can then be laid into storage with fixtures successively folded back on each other to fully fill a storage space, leaving minimal air space in the storage space (e.g. a shipping container). In some embodiments, each layer is laterally offset a small amount from the layer below for securing mechanisms such as those described with respect to FIG. 5.

A plurality of first fixtures 202 are shown from the side for illustrative purposes only. Those of ordinary skill in the art will recognize that the other side of cable 124 is secured using a plurality of second fixtures 204, not shown, as they contain the same features.

If a subsection of the long array of fixtures needs to be removed for an installation, the cable span 302 that links fixtures can be cut to detach a clearly defined number of connectors all still held in place by the fixtures. The fixture 202 also comprises a separation point 304 after every receptacle position allowing detachment of any desired number of connectors 122 and cable segments. In some embodiments, each receptacle 208 in each fixture 202 contains an optional feature 306 that prevents lateral movement along each layer of fixtures. In some embodiments, this feature 306 is a rib built into each receptacle, such that the feature 306 fits into a gap between features in the next layer of fixtures in the fixture array. In other embodiments, the receptacle 208 is sized so that the width of each side of a receptacle 208 is equal in size to a gap between those sides in adjacent receptacles.

Figure 4:
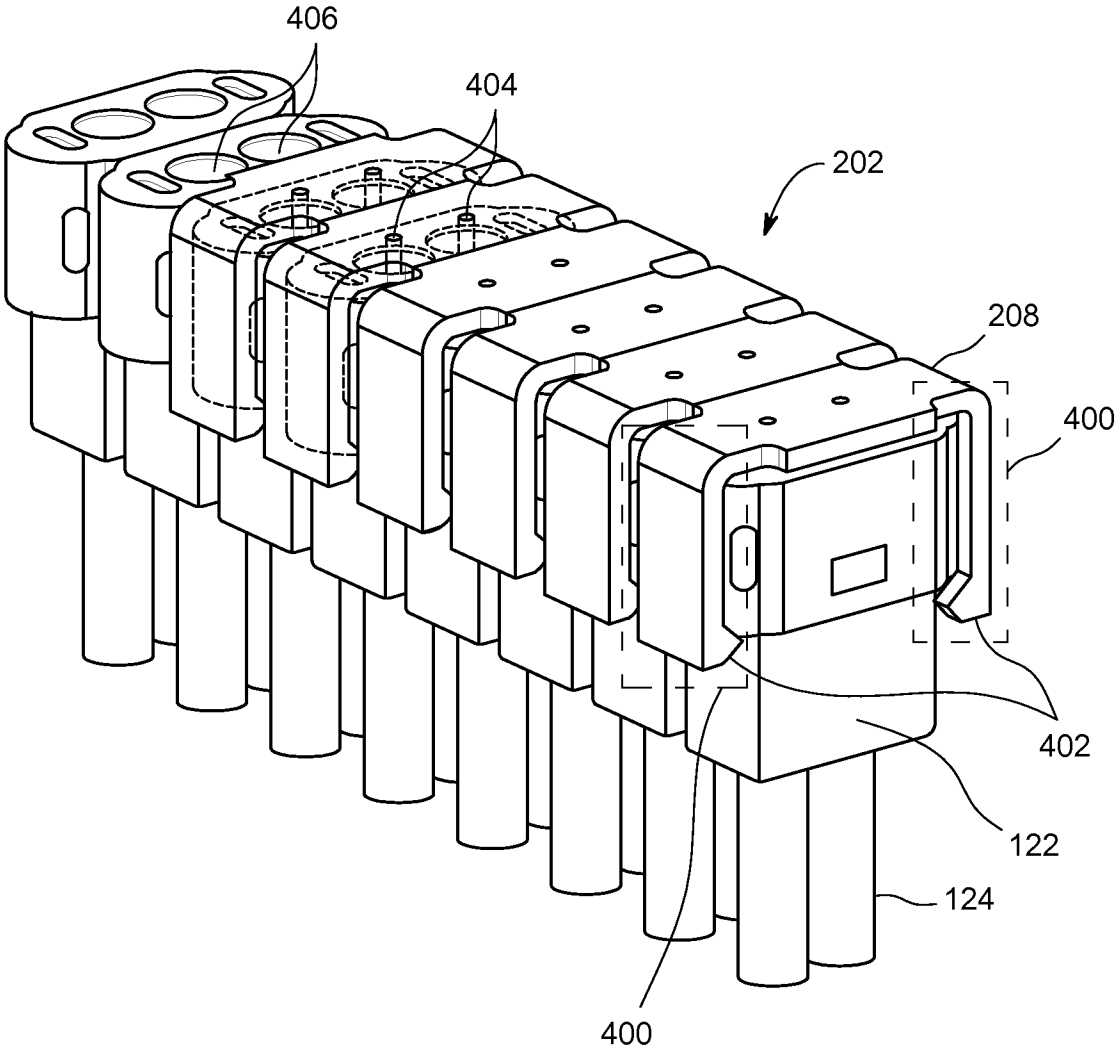
FIG. 4 is a more detailed illustration of a portion of the fixture in accordance with exemplary embodiments of the present invention.

FIG. 4 is a more detailed illustration of a portion of the fixture in accordance with exemplary embodiments of the present invention.

The fixture 202 contains a plurality of locking receptacles 208. Each of the locking receptacles 208 comprises a locking mechanism 400 to secure connector 122 in place during storage and shipping. The locking mechanism 400 comprises, according to one embodiment, two or more locking tabs 402 which flex to allow a connector 122 to be snapped into the receptacle 208. The tabs 402 then spring back into place securing connector 122. According to some embodiments, the width of tabs 402 is equal to a gap between adjacent tabs 402 on each fixture. Accordingly, when a fixture layer is stacked upon another fixture layer, the tabs 402 interlock, disabling motion in at least one direction.

In some embodiments, each receptacle 208 includes two or more protruding features 404 which prevent rotation of the connector 122 out of the receptacle 208. The feature 404 (e.g., a cylindrical feature) protrudes into an opening 406 in the connector 122 (e.g., a cylindrical hole).

The receptacles of second fixture 204 are similarly fashioned, allowing a long cable segment with multiple connectors to be secured from movement and easily detached during installation at each microinverter, thus avoiding entanglement and enabling an installer to move easily about an installation area.

Figure 5:
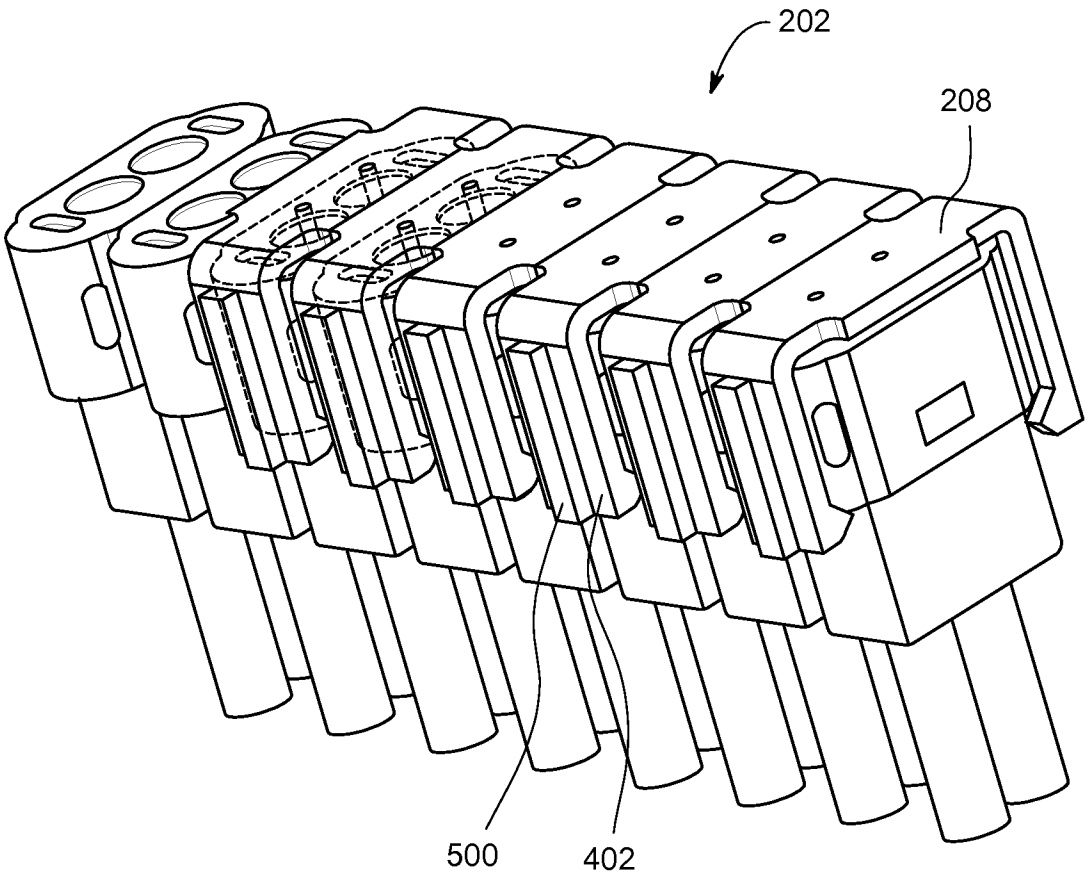
FIG. 5 is another detailed illustration of another embodiment of a portion of a fixture in accordance with exemplary embodiments of the present invention.

FIG. 5 is another detailed illustration of another embodiment of a portion of a fixture in accordance with exemplary embodiments of the present invention.

According to this embodiment, the receptacle 208 contains the locking tabs 402 which each additionally contain a rib 500 (e.g., a total of two ribs per locking receptacle 208). Each rib 500 allows the secured cables to be stacked vertically, avoiding movement relative to a lower layer of fixtures. The rib 500 runs up an outward facing side of each of the tabs 402 on the receptacle 208 and locks into the gap between other locking tabs on a lower level of fixtures in a stack of fixtures. The rib 500 then successfully prevents a sliding motion in at least one direction. The other directions may be constrained by a simple tray or a box wall in a storage container. Those of ordinary skill in the art may recognize that the rib 500 is just one example of securing each layer of fixtures with cables against other layers from movement.

Figure 6:
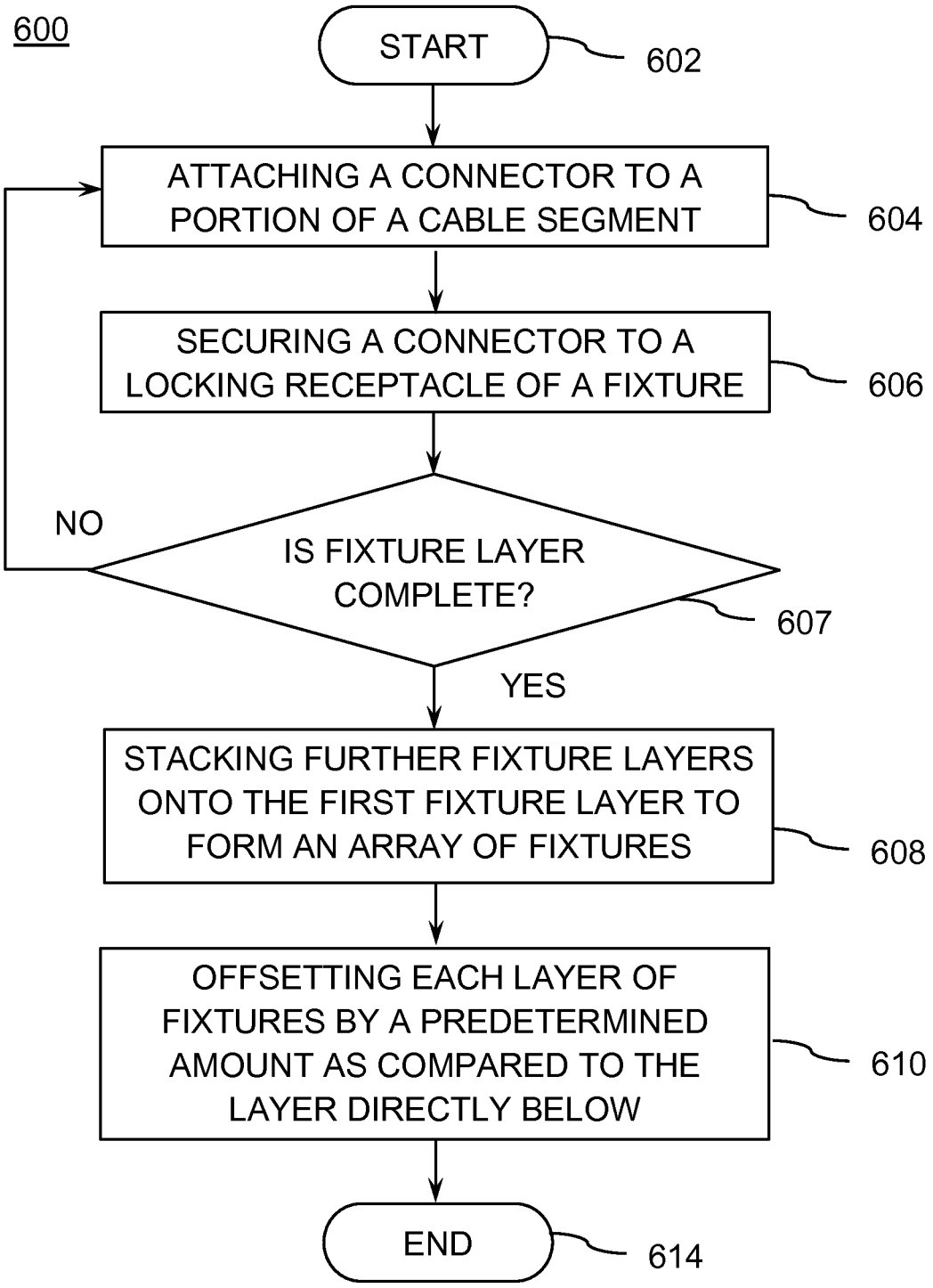
FIG. 6 is a flow diagram for a method for securing a segmented cable for shipping and storage in accordance with exemplary embodiments of the present invention.

FIG. 6 is a flow diagram for a method 600 for securing a segmented cable for shipping and storage in accordance with exemplary embodiments of the present invention.

The method begins at step 602 and proceeds to step 604. At step 604, a connector is attached to a portion of a cable segment. At step 606, the connector is then secured to a locking receptacle on the body of the fixture. At step 607, the method determines whether a fixture layer is complete. In some embodiments, a completed layer comprises every locking receptacle on the body of two opposing fixtures to be securing adjacent connectors of a cable segment. If the fixture layer is not complete, the method returns to step 604. If the fixture layer is complete, the method proceeds to step 608.

In some embodiments, 8 to 16 connectors can be secured per fixture. As cable length increases, each portion of cable is secured to two more fixtures, forming another layer. This fixture layer is stacked on top of the layer directly below at step 608, forming a fixture array. In some embodiments, each locking receptacle comprises two or more locking tabs extending outwards from the body of the receptacle to secure a connector of the power cable. Additionally, each of the locking tabs has a rib on its outward facing side. As the layers of fixtures are stacked, each layer can be offset by a specified distance at step 610 so that the ribs on successive layers fall between two ribs on a previous layer, preventing movement in at least one direction. The method terminates at step 614.

The foregoing description of embodiments of the invention comprises a number of elements, devices, circuits and/or assemblies that perform various functions as described. These elements, devices, circuits, and/or assemblies are exemplary implementations of means for performing their respectively described functions.

While the foregoing is directed to embodiments of the present invention, other and further embodiments of the invention may be devised without departing from the basic scope thereof, and the scope thereof is determined by the claims that follow.

The invention claimed is:

1. An apparatus for securing a segmented power cable with a plurality of connectors, for shipping and storage, the apparatus comprising:

two or more fixtures, physically detached from each other, each comprising a plurality of locking receptacles along a body of each fixture, and each locking receptacle of the plurality of locking receptacles comprises:

a locking mechanism to secure a connector of the segmented power cable to a corresponding locking receptacle of the plurality of locking receptacles, wherein the locking mechanism comprises:

two or more corresponding locking tabs, such that for each of two adjacent locking receptacles each of the two or more corresponding locking tabs flex open independently from each other to snap a corresponding connector of the plurality of connectors in place; and two or more protruding features extending from a base from which the two or more locking tabs extend and preventing rotational movement of a corresponding connector of the plurality of connectors snapped into place.

2. The apparatus of claim 1, wherein the two or more protruding features are configured to protrude into corresponding openings on each connector of the plurality of connectors.

3. The apparatus of claim 2, wherein two fixtures of the two or more fixtures secure one layer of the segmented power cable on opposing sides.

4. The apparatus of claim 3, wherein the plurality of connectors on the segmented power cable are connected to the two opposing fixtures.

5. The apparatus of claim 4, wherein further layers of the segmented power cable are each secured by two more fixtures per layer, stacked upon a previous layer.

6. The apparatus of claim 5, wherein the further layers are stacked at an offset from the previous layer.

7. The apparatus of claim 2, wherein each locking receptacle of the plurality of locking receptacles further comprise a rib on an outward facing side of each of the two or more locking tabs.

8. The apparatus of claim 7, wherein two fixtures of the two or more fixtures secure one layer of the segmented power cable on opposing sides.

9. The apparatus of claim 8, wherein the plurality of connectors on the segmented power cable are connected to the two opposing fixtures of the two fixtures and further layers of the segmented power cable are each secured by two more fixtures per layer, stacked upon the previous layer.

10. The apparatus of claim 9, wherein the further layers are stacked at an offset from the previous layer, the rib on each locking receptacle fitting between two ribs on the previous layer, preventing sliding in at least one direction.

11. The apparatus of claim 1, wherein each of the two or more fixtures comprise a separation point after each locking receptacle where a portion of the fixture can be detached according to a specified number of cable connectors or cable length.

12. The apparatus of claim 1, wherein the apparatus is assembled during manufacture of the segmented power cable.

13. The apparatus of claim 1, wherein the two or more protruding features extend within an area defined between the two or more corresponding locking tabs.

14. An apparatus for securing a segmented power cable with a plurality of connectors, for shipping and storage, the apparatus comprising:

two or more fixtures, physically detached from each other, each comprising a plurality of locking receptacles along a body of each fixture, wherein each of the plurality of locking receptacles comprises a locking mechanism to secure a connector of the segmented power cable to a corresponding locking receptacle of the plurality of locking receptacles, and wherein the locking mechanism comprises:

two or more corresponding locking tabs, such that for each of two adjacent locking receptacles each of the two or more corresponding locking tabs flex open independently from each other to snap a corresponding connector of the plurality of connectors in place; and two or more protruding features extending from a base from which the two or more locking tabs extend and preventing rotational movement of a corresponding connector of the plurality of connectors snapped into place, wherein the two or more protruding features are configured to protrude into corresponding openings on each connector of the plurality of connectors.

* * * * *